US005294913A

United States Patent [19]

Mower et al.

[11] Patent Number: 5,294,913

[45] Date of Patent: Mar. 15, 1994

[54] INDOOR/OUTDOOR PORTABLE BASKETBALL SCOREBOARD

[75] Inventors: Barry D. Mower, Layton; Lonny R. Matherne, Pleasant View; Robert W. Adams, Kaysville, all of Utah

[73] Assignee: Lifetime Products, Inc., Clearfield, Utah

[21] Appl. No.: 829,455

[22] Filed: Jan. 31, 1992

[51] Int. Cl.[5] ..... G08B 23/00

[52] U.S. Cl. ..... 340/323 R; 273/1.5 R; 116/222; 377/5; 364/411

[58] Field of Search ..... 340/323 R; 364/410, 364/411; 273/1.5 R; 116/222; 377/5

[56] References Cited

U.S. PATENT DOCUMENTS

| | | | |
|---|---|---|---|
| 4,045,788 | 8/1977 | Castelli et al. | 340/309.2 |
| 4,097,855 | 6/1978 | Salvo | 340/323 R |
| 4,858,920 | 8/1989 | Best | 273/1.5 R |
| 4,904,981 | 2/1990 | Mele et al. | 340/323 R |
| 4,956,775 | 9/1990 | Klamer et al. | 364/411 |
| 5,014,983 | 5/1991 | Saunders | 173/1.5 R |

OTHER PUBLICATIONS

Double Shot Electronic Basketball Game, Model #9955, product sheet, Lifteime Products Inc., Feb. 1990.

*Primary Examiner*—John K. Peng

*Assistant Examiner*—Edward Lefkowitz

*Attorney, Agent, or Firm*—Madson & Metcalf

[57] ABSTRACT

A portable electronic scoreboard comprising a housing with a display face, an electronic mechanism disposed within the housing, and a score registering assembly. The housing back configuration is amenable to releasable attachment to a pole or a flat surface such as a wall. The housing back face configuration comprises a longitudinal channel capable of disposition adjacent to a pole and a strap fastener extendable about the pole. The housing back configuration also comprises a pair of flat surfaced wings having slots capable of receiving bolts of the like to secure the housing to a wall. The score registering assembly may be positioned to detect the successful passage of a basketball through a basketball goal. The score registering assembly comprises a paddle and a switch. The paddle actuates the switch if a basketball passing through the goal causes the paddle to change from a ready to a reactive position. The switch thereby detects successful scores and communicates such scores to the electronic mechanism for processing and display. The score registering assembly also comprises a self-locking adjustable arm attachment assembly for securing the score registering assembly to the basketball goal. The arms of the attachment assembly are laterally adjustable and configured with grooves to permit clamping engagement with the rim plate portion of the basketball goal.

26 Claims, 6 Drawing Sheets

INDOOR/OUTDOOR PORTABLE BASKETBALL SCOREBOARD

FIELD OF THE INVENTION

The present invention relates to an apparatus used for regulating play in a basketball game, and more particularly to a portable scoreboard for indoor or outdoor use to regulate play during various types of basketball games.

BACKGROUND OF THE INVENTION

Because of the popularity of basketball, particularly in the United States, many people play the sport and devote considerable time to the development of their basketball skills. Millions of basketball goals have been mounted on barns, telephone poles, garages, and the like so basketball enthusiasts can conveniently enjoy a game of basketball or the solitude of shooting a few baskets. In recent years, there has been a proliferation of basketball poles installed at homesites next to a driveway or the street, to which a backboard and a goal are attached. Additionally, portable basketball standards are now becoming commercially available for those basketball enthusiasts who do not have sufficient space to have a basketball standard installed, or who are not permitted to permanently install a basketball standard where they live. As soon as the backboard and goal or the portable basketball standard are in place, a game of basketball soon ensues.

If there is not enough players to play a game of basketball, a free throw or 3-point shooting contest or any of a number of games derivative from basketball such as "HORSE" or "Around the World" may be played. When a game of basketball is played at a home installed basketball standard, whether indoor or outdoor, there are usually a couple of aspects of the game which differ from and actual regulation game. Usually, a friendly game of basketball at a school yard, on a driveway, or in the street will not have officials to regulate play, nor will there be a scoreboard. Unfortunately, due to the lack of these two elements, arguments or disputes over the score, who gets possession of the ball first, and how long to play have disrupted many a friendly game. Players in a friendly neighborhood game have usually circumvented the need for officials by calling their own fouls and infractions, but heretofore, there has not been any true substitute for a scoreboard other than the players mentally keeping track of the score and/or calling out the score after each basket. Most scoreboards available are intended for institutional use rather than home use. Such scoreboards are large, heavy, complex, and expensive, and not a viable option for the basketball enthusiast who would like to have scoreboard capability at home. Of course, flip card scoreboards have been used, but unless a person other than the players is available to flip the cards to the appropriate score after each basket is made, the game is interrupted while one of the players moves the flip cards to the correct score. Hence, the flip card scoreboards are rather for the convenience and enjoyment of spectators, if any, than the players.

Being unable to keep score automatically has been a source of frustration during friendly neighborhood play. Also, some of the features of a college or professional game can not be simulated for home or school yard play. For example, most friendly neighborhood games do not enjoy the use of a shot clock or a time clock with a final buzzer. To provide visual display and audio signals could also enhance the basketball enthusiast's enjoyment during home or school yard play.

It would be an advance in the art if a device were provided that could keep score and otherwise regulate aspects of the game of basketball for the basketball enthusiast playing the game at his own home or a local school yard. It would be a further advance if the device were portable, could be programmed to regulate play during other basketball derivative games, and utilized means that would automatically register baskets made.

OBJECTS AND BRIEF SUMMARY OF THE INVENTION

In view of the foregoing needs and problems experienced by basketball enthusiasts during home and school yard basketball play, it is a primary object of the present invention to provide a portable scoreboard apparatus that can simulate features of college and professional basketball games such as a shot clock and a time clock.

It is another object of the present invention to provide an apparatus that not only keeps score, provides visual display of the score and time, and provides audio signals, but also has the capability to regulate play for several games derived from basketball.

A further object of the present invention is to provide a portable scoreboard apparatus that can be used indoors or outdoors and that can be removed and stored for security purposes when it is not in use, and can be easily installed for use.

Another object of the present invention is to provide automatic scoring of baskets made by triggering a scoring mechanism that can be retrofit and secured to almost all basketball goals.

Still another object of the present invention is to provide a scoreboard apparatus that enhances interest in the game by converting a basketball standard in a school yard or at a home into an audio/visual experience similar to a video game, but with the players taking a physically active role in the game.

The foregoing objects are accomplished by a portable electronic scoreboard apparatus of the present invention which comprises a housing with a display face, an electronic mechanism disposed within the housing, a visual display disposed adjacent the display face, an actuator, and a score registering assembly.

The housing is small, lightweight, durable, shock resistant, water resistant, portable and may easily be handled by a child or youngster. Hence, it can be installed quickly and easily, and it can be removed for storage so that it does not become the object of theft or vandalism.

The housing has a back configuration amenable to releasable attachment to a pole or a flat surface such as a wall from which a basketball backboard and goal may be suspended. The configuration of the back of the housing comprises a longitudinal channel disposed between a pair of flat surfaced wings. The longitudinal channel is preferably arcuate in transverse section so that it is capable of disposition adjacent to a pole. The housing is then releasably secured to the pole by a strap fastener extendable about the pole in wrap-around fashion. The strap fastener is secured about the pole using any suitable fastening means such as buttons, snaps, or a hook and pile fastener assembly such as Velcro®.

If the structure to which the housing is to be secured is a wall or a rectangular pole the flat surfaced wings may be positioned to engage the wall in relatively flush engagement. The housing may then be secured to the wall by fasteners such as screws, nails, bolts, or the like disposed through a pair of slots positioned on opposite sides of the housing. For versatility, the slots may be configured to accept interchangeably the strap fastener used for pole attachment and the fastener for wall attachment.

Preferably, the housing is configured such that if disposed generally vertically when attached to a wall or pole, the display face is inclined inwardly from top to bottom. Such incline reduces the glare that may occur if the portable scoreboard of the present invention is used outdoors.

The electronic mechanism, housed within the housing, receives input information from various sources, processes the input information received according to a preselected or default mode of operation, and provides certain output information to the visual display. The electronic mechanism comprises conventional electric circuitry and microprocessors known to those skilled in electrical arts relating to informational displays and the like. Such electric circuitry and microprocessors regulate the various functions of the electronic scoreboard by converting the input information received into signals for the visual display. Because the electronic scoreboard is intended to be portable, the electronic mechanism is preferably battery operated. For the protection of the electronic mechanism against rough handling and excessive moisture, the electronic mechanism is enclosed within the shock resistant and water resistant housing.

The electronic mechanism regulates the various functions of the electronic scoreboard. It operates under one of a plurality of modes of operation. The electronic scoreboard can function as a traditional scoreboard, can regulate a game concluded by successfully making a predetermined number of baskets, can convert the basketball goal into an arcade-type game where the object is to make the greatest number of baskets in a predetermined amount of time, and can regulate a player comparative skills game similar to "HORSE."

For example, under the traditional scoreboard mode of operation, the electronic scoreboard keeps a running total score. The score may be entered manually. Under this basic mode of operation, however, the scoreboard has other functions which are available. Each basket made may be recorded automatically when the score registering assembly, to be described in more detail below, is used. Additionally, a time clock is provided which can be set to a predetermined period of time for play. The time clock counts down the time remaining in the game, and an auditory signal may be provided to indicate the end of the time period. Further, a shot clock is provided which can be set to a predetermined period of time within which a player must attempt a shot or must make a basket. Any combination of these functions is available, and under a preferred embodiment of the present invention, the score and the time remaining may be alternatively displayed using the same characters on the visual display.

An additional function regulated by the electronic mechanism is the provision of auditory signals to indicate events such as the counting down of time, the end of a time period or the expiration of the shot clock, when a basket is made, or an acknowledgement that the scoreboard has been turned on and is operational. In a preferred embodiment, the volume of the auditory signals may be manually adjusted.

The visual display receives and responds to the output information from the electronic mechanism and displays an expression of the output information. A preferred embodiment of the present invention utilizes a visual display comprising a reflective color display which intensifies visual output if ambient light increases. The liquid crystal technology for such a visual display is presently being marketed by Taliq Corporation of Sunnyvale, Calif. as Varilite® color displays.

The actuator functions to activate the electronic mechanism and to supply certain input information to the electronic mechanism. In a preferred embodiment of the invention, the actuator is responsive to manually applied pressure exceeding a predetermined threshold such as the pressing of a membrane switch pad, a touch plate or a button.

The score registering assembly communicates with the electronic mechanism from a remote location. In a preferred embodiment, the score registering assembly is connected to the electronic mechanism via a standard telephone jack connection so that the score registering assembly may be positioned adjacent a basketball goal for detecting the successful passage of a basketball through the basketball goal and signaling the electronic mechanism thereof. The score registering assembly comprises a switch and a paddle. The switch detects successful scores and communicates such successful scores to the electronic mechanism for processing and display. The paddle is movable between a ready position and a reactive position. The paddle actuates the switch if a basketball successfully passes through the basketball goal causing the paddle to move form the ready position to the reactive position.

The score registering assembly has an adjustable arm attachment assembly for securing the score registering assembly to the basketball goal. The arms of the attachment assembly are laterally adjustable for clamping engagement with the rim plate portion of the basketball goal. The movement of the arms is controlled by the turning of a knob with a gear which engages notches in each arm and advances each arm if the knob is turned.

These and other objects and features of the present invention will become more fully apparent through the following description and appended claims taken in conjunction with the accompanying drawings.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
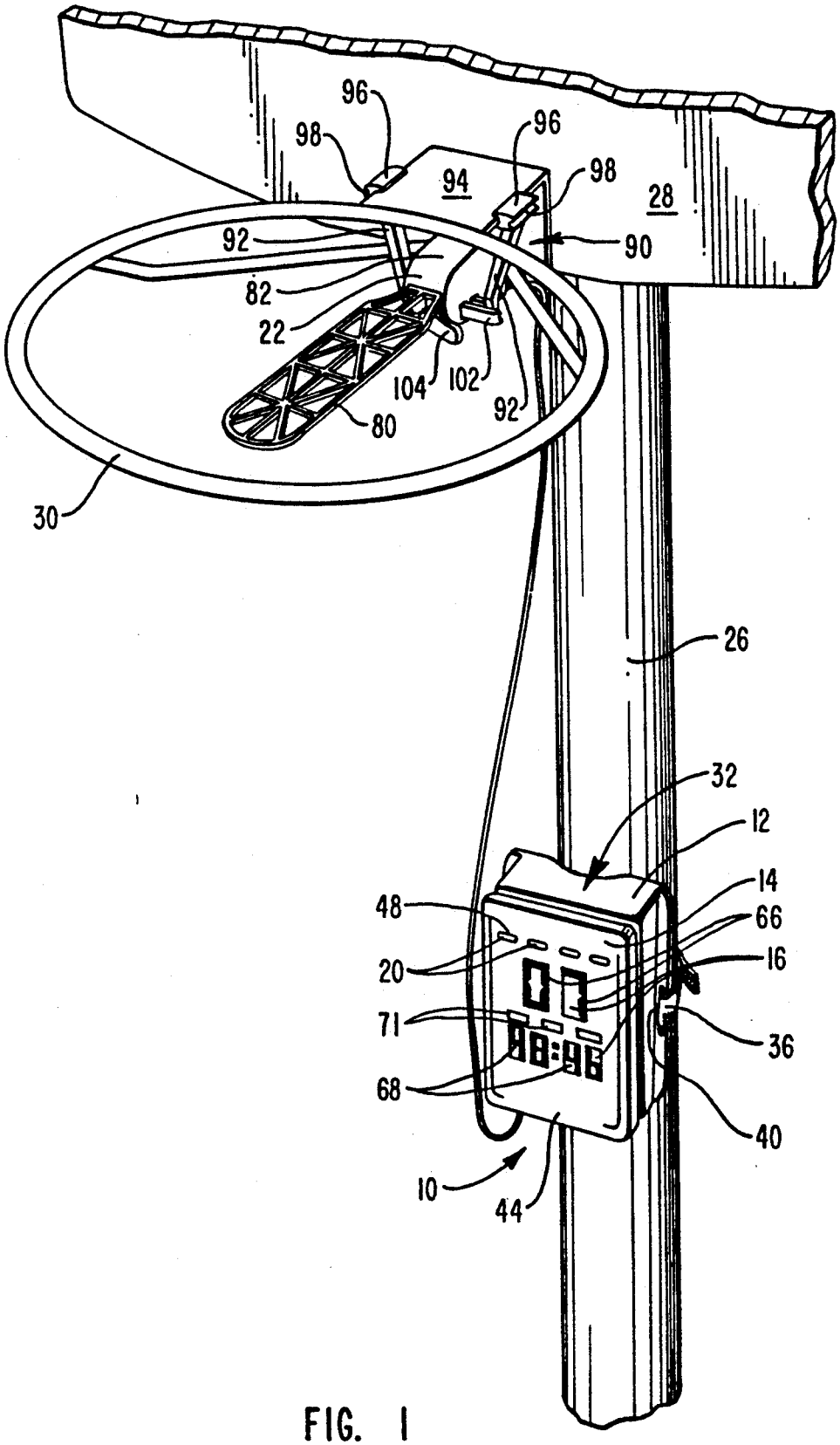
FIG. 1 is a perspective view of the portable electronic scoreboard of the present invention showing the housing secured to a pole and connected to a score registering assembly which is secured to a rim plate of a basketball goal such that the paddle subtends the rim portion of the basketball goal.

Referring now specifically to the drawings, wherein like numerals indicate like parts throughout, the portable, indoor/outdoor electronic scoreboard of the present invention, generally designated 10, comprises a housing 12 with a display face 14, an electronic mechanism 16 disposed within the housing 12, a visual display 18 disposed adjacent to and partially visible through the display face 14, an actuator 20, and a score registering assembly 22.

As is shown best in FIGS. 1 and 3–5, the housing 12 is small, lightweight, portable and may easily be handled by a child or youngster. Additionally, since the housing 12 can easily be removed from its attachment with a pole or wall and can be detached from its connection with the score registration assembly 22, the housing 12 can be removed when not in use. This enables an owner of the electronic scoreboard 10 to remove the housing 12 for security and storage.

Figure 2:
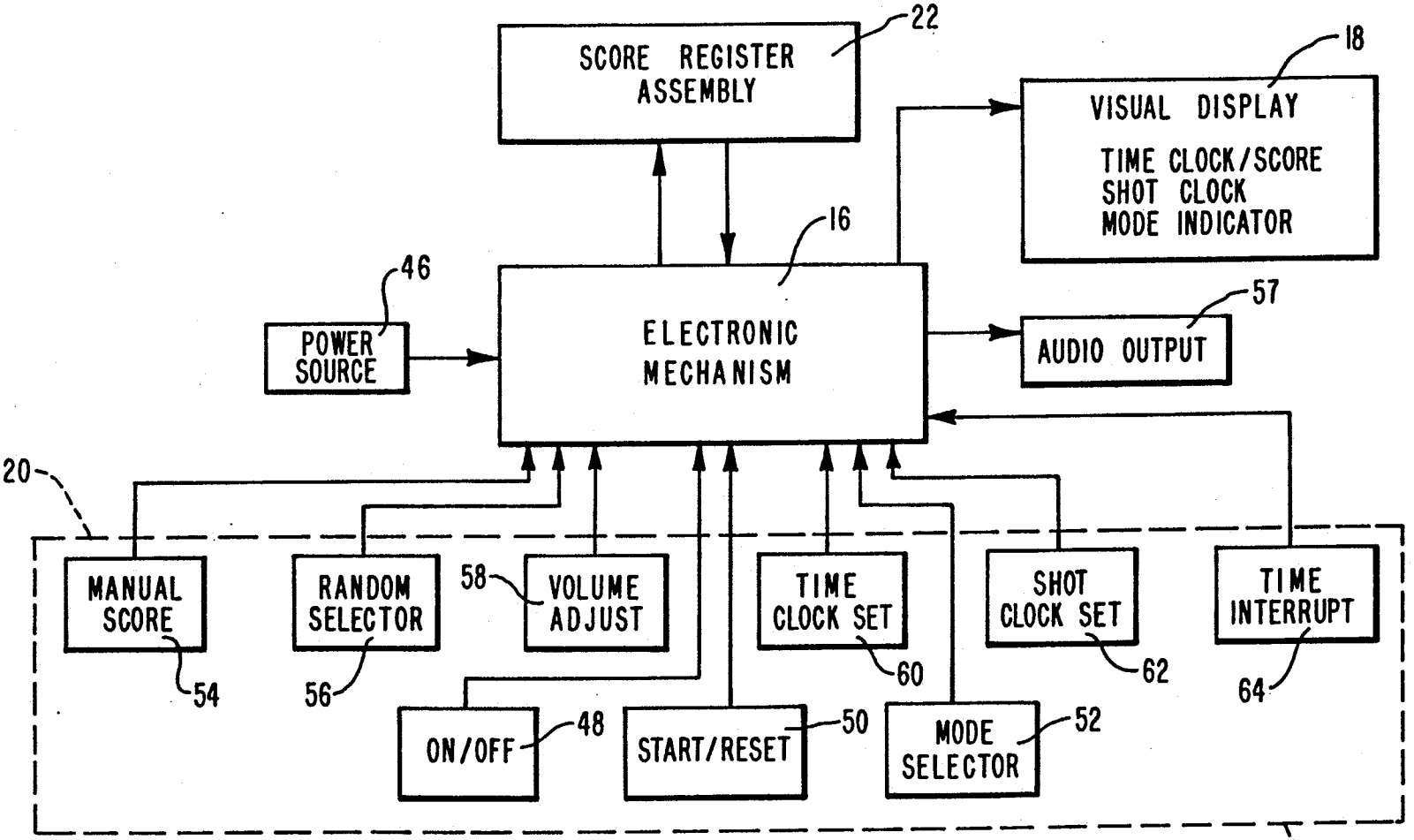
FIG. 2 is a schematic function diagram flow chart of the electronic scoreboard of the present invention showing a preferred embodiment of the actuator in phantom lines.
Figure 3:
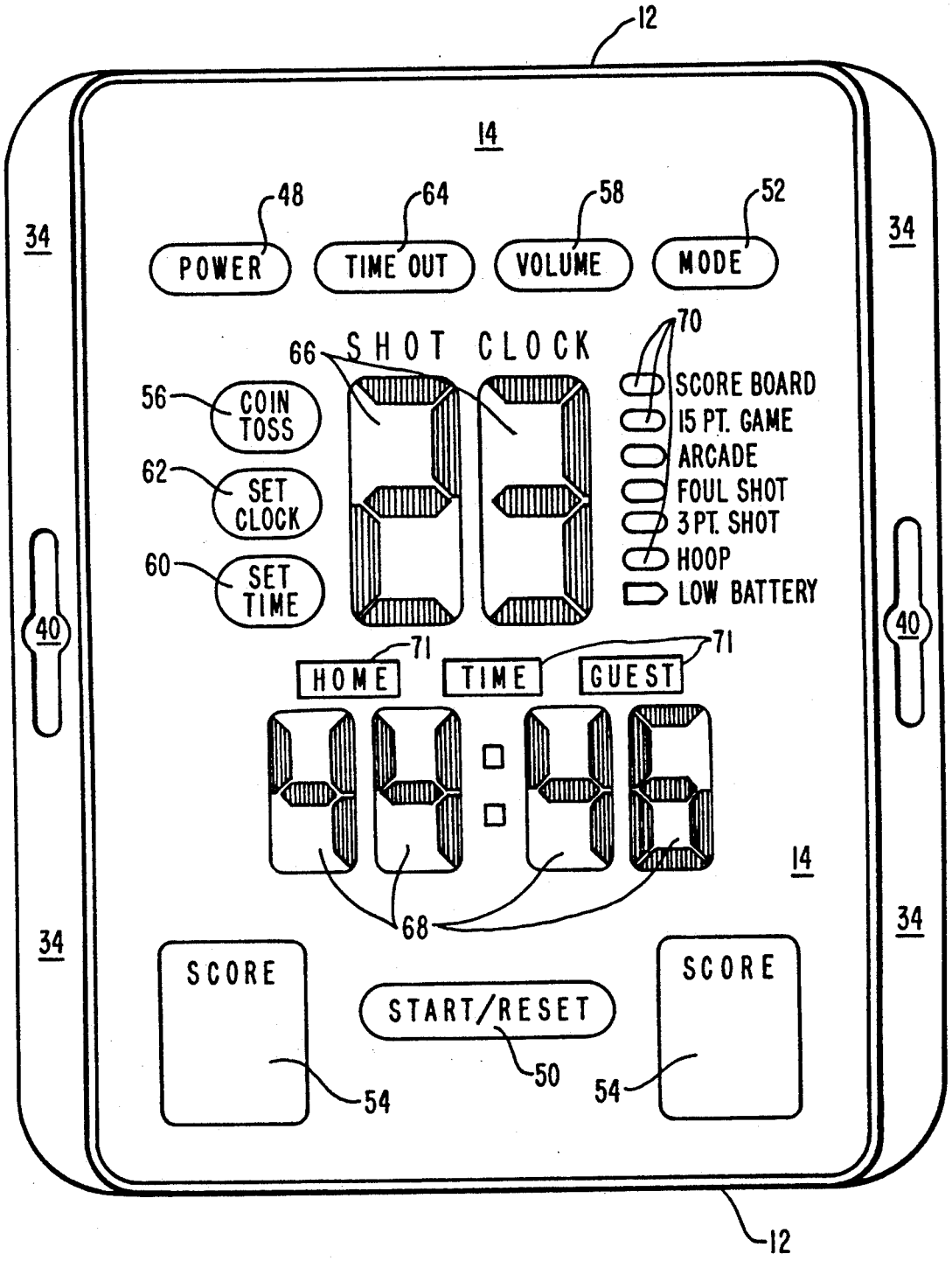
FIG. 3 is a schematic view of the display face of the housing.

The housing 12 is the protective shell for the electronic mechanism 16 (shown only in FIG. 2). Consequently, the housing 12 is preferably constructed of a durable material such as a polymeric or plastic material which is capable of withstanding shock and rough treatment because the nature of basketball is that if the scoreboard 10 is disposed anywhere near the playing area, a basketball will occasionally hit the scoreboard 10 as the result of an errant pass or shot. It is also preferable, since it is anticipated that the scoreboard 10 of the present invention will be used outdoors and possibly be subject to inclement weather, that the housing 12 be sealed sufficiently to be water resistant or vented to allow for evaporation.

Figure 4:
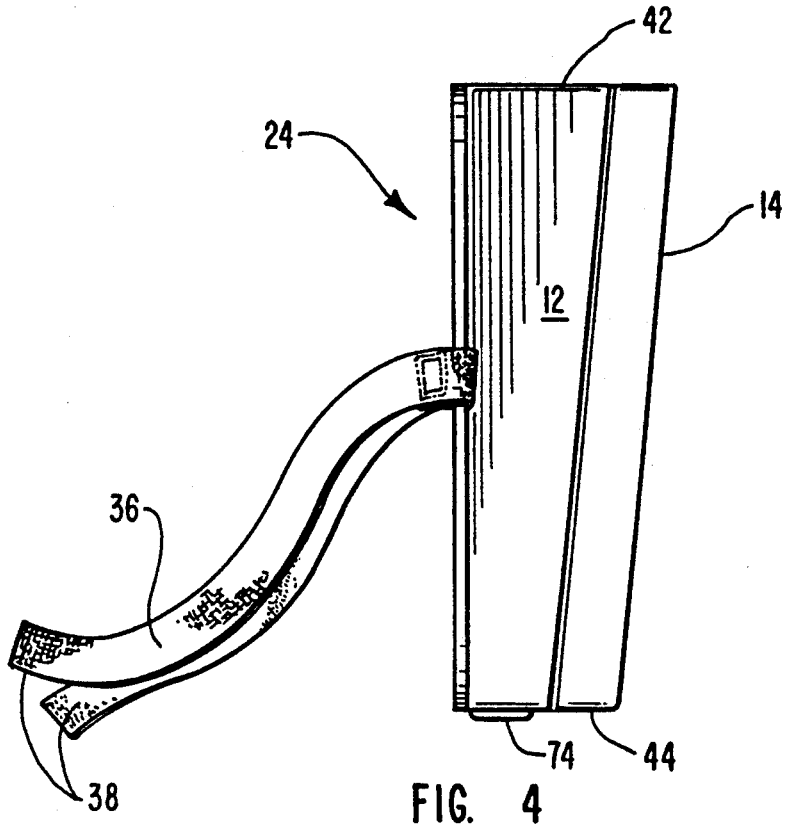
FIG. 4 is a side elevational view of the housing showing the incline of the display face and the fastening strap.
Figure 5:
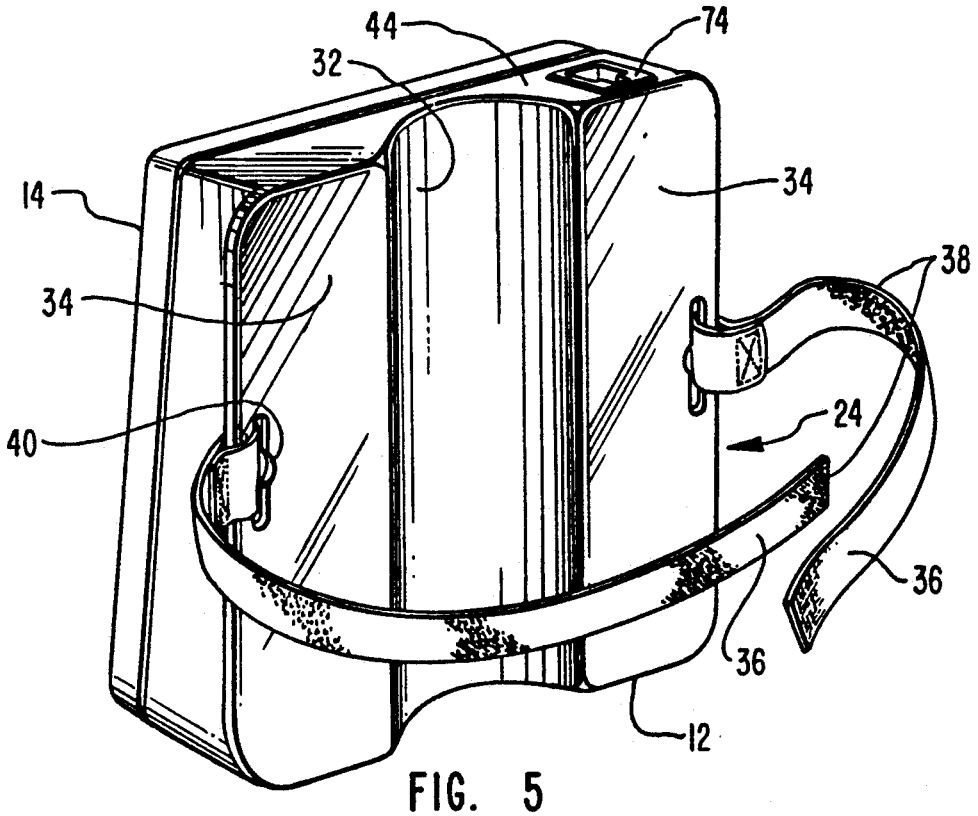
FIG. 5 is a perspective view of the housing disposed in an inverted position to show the configuration of the back and the location of the standard modular telephone jack receiver.

As best illustrated in FIG. 5, the housing 12 has a back, generally designated 24, configured to be amenable to releasable attachment to a pole 26 (see FIG. 1) or a flat surface such as a wall (not shown) from which a basketball backboard 28 and goal 30 may be suspended. The configuration of the back 24 of the housing 12 comprises a longitudinal channel 32 disposed between a pair of flat surfaced wings 34. The longitudinal channel 32 is preferably arcuate in transverse section so that it is capable of disposition adjacent to a pole 26. With this configuration, the housing 12 is particularly suitable for attachment to various diameter poles 12. A longitudinal channel 32 having a width of approximately two inches can accommodate attachment to poles 26 having 3½ to 4½ inch diameters, the sizes of poles 26 typically used to support a basketball backboard 28 and goal 30. The housing 12 is then releasably secured to the pole 26 by a strap fastener 36 (see FIGS. 4 and 5) extendable about the pole 26. The strap fastener 36 is secured about the pole 26, as shown in FIG. 1, using any suitable fastening means such as buttons, snaps, or a hook and pile fastener assembly 38. Although FIGS. 4 and 5 show a two-piece strap fastener 36 which is permanently secured to the housing 12, it should be understood that a one-piece strap fastener 36 may be used which loops through slots 40 for fastening engagement and can be removed from engagement with the housing 12 so that housing 12 can be secured to a flat wall without interference from a strap fastener 36.

If the structure to which the housing 12 is to be secured is a wall or a rectangular pole, the flat surfaced wings 34 may be positioned to engage the wall in relatively flush engagement. The housing 12 may then be secured to the wall by fasteners such as screws, nails, bolts, or the like (not shown) disposed through a pair of slots 40 disposed on opposite sides of the housing 12 (see FIG. 3). For versatility, the slots 40 may be configured to accept interchangeably the strap fastener 36 used for pole 26 attachment and the fastener (not shown) for wall attachment.

Preferably, the housing 12 is configured such that if disposed generally vertically when attached to a wall or pole 26, the display face 14 is inclined inwardly from the top 42 to the bottom 44 of the housing 12. Such incline reduces the glare that may occur if the portable scoreboard 10 of the present invention is used outdoors in the sunlight or indoors under lighting that would ordinarily cause a glare.

The electronic mechanism 16, housed within the housing 12, receives input information from various sources, processes the input information received according to a preselected or default mode of operation, and provides certain output information to the visual display 18. The electronic mechanism 16 comprises conventional electric circuitry and microprocessors which regulate the various functions of the electronic scoreboard 10 by converting the input information received into signals for the visual display 18.

The electronic mechanism 16 regulates the various functions of the electronic scoreboard 10. The functions that the electronic mechanism 16 regulates can best be understood by reference to FIG. 2. As with all electronic devices, the electronic mechanism 16 is connected to a power source 46. Because the electronic scoreboard is intended to be portable, the electronic mechanism is preferably battery operated, although other sources of power may be used. The electronic mechanism 16 is in communication with and responsive to input provided by the actuator 20. In FIG. 2, the actuator 20 is symbolically designated by the phantom lines which enclose various input information suppliers. These input information suppliers comprise a power or on/off switch 48, a start/reset switch 50, and a mode selector 52. Additional input information suppliers include a manual score actuator 54, a random selector 56, a volume adjust or audio volume selector 58, a time selector 60, a shot clock time selector 62, and a pause selector 64. The actuator 20, in any particular embodiment of the present invention, may consist of one or any combination of the input information suppliers or any additional input information suppliers.

Additionally, it is preferred that the actuator 20 be responsive to manually applied pressure exceeding a predetermined threshold such as the pressing of a membrane switch pad, a touch plate, or a button. Actuation by touch enables the housing 12 to have a flexible, but water resistant display face 14 through which force applied on the display face 14 at a designated area will actuate the actuator 20. For ease in description, the actuation of the actuator 20 and/or any of the input information suppliers will be presumed to be by touch on the display face 14, although it should be understood that actuation can be accomplished in many known ways and that the actuator 20 may be located other than in touching communication with the display face 14. It is also preferred, that actuator 20 include at least the on/off switch 48 which activates the electronic mechanism 16.

The start/reset switch 50, if touch engaged, signals the electronic mechanism 16 to start its operation of the game mode selected. With the preferred embodiment, if the start/reset switch 50 is touch engaged twice within a predetermined time, the current game is terminated and a new game starts.

In a preferred embodiment of the present invention, the electronic scoreboard 10 operates under one of a plurality of modes of operation regulated by the electronic mechanism 16. The mode selector 52 determines which mode of operation the electronic mechanism 16 will employ. By repeatedly touch engaging the mode selector 52, a series of modes of operation are presented to the user for selection. Although a number of modes and variations thereof can be programmed into the electronic mechanism 16, it is preferred that the electronic scoreboard 10 of the present invention be programmed to operate under at least some basic modes of operation. It is preferred that electronic scoreboard 10 can operate as a traditional scoreboard, can regulate a game concluded by successfully making a predetermined number of baskets, can convert the basketball goal into an arcade-type game where the object is to make the greatest number of baskets in a predetermined amount of time, and can regulate a player comparative skills game similar to "HORSE."

The manual score actuator 54 is used to increase or decrease the score displayed. In one mode of operation, the electronic scoreboard 10 can be operated under the traditional scoreboard mode of operation (without a time clock or a shot clock), the electronic scoreboard 10 keeps a running total score. The score is entered manually by touch engaging the manual score actuator 54. It is preferred that if the manual score actuator 54 is touch engaged that the score is increased in one point increments, but if the manual score actuator 54 is touch depressed and held down, the score will sequentially decrease until the desired score is reached.

The random selector 56 when touch engaged signals the electronic mechanism 16 to simulate a coin toss to select randomly which player or team is given possession of the ball first. The use of the random selector 56 is provided to avert disputes regarding possession of the ball to start a game.

An additional function of the electronic mechanism 16 is the regulation of an audio output 57 which provides auditory signals to indicate events such as the counting down of time, the end of a time period or the expiration of the shot clock, or an acknowledgement that the scoreboard 10 has been turned on and is operational. In a preferred embodiment, the volume of the auditory signals may be manually adjusted. The audio volume selector 58 may be touch engaged to select the volume desired.

The time selector 60 is used to adjust the length of game time. In a preferred embodiment, the time selector 60 is touch engaged to increase the playing time in one minute increments, and is touch depressed and held down to decrease the playing time sequentially in one minute increments until the desired time is selected.

The shot clock time selector 62 is used to adjust the length of the time period the shot clock counts down. It is preferred that the various periods of time be available for selection by repeatedly touch engaging the shot clock time selector 62 until the time period desired is selected.

The pause selector 64 is used to interrupt the continued count down of time on the time clock and/or the shot clock. The pause selector 64 is a "time out" feature that will temporarily stop the continued count down of time on all clocks operating when the pause selector 64 is touch engaged. The clocks begin again if the pause selector 64 is thereafter touch engaged.

The visual display 18 receives and responds to the output information from the electronic mechanism 16 and displays an expression of the output information. The visual display 18 has one or more individual displays. A preferred embodiment of the present invention utilizes at least three individual displays, a two-character shot clock 66, a four-character time clock/score display 68, and a mode indicator 70. With this preferred embodiment, the time remaining and the score alternatively display so that a single four-character display can accommodate both functions. In addition, a pixel 71 can be provided which illuminates the displays of "HOME," "TIME," and "GUEST" according to whether the time clock/score display 68 is then displaying time or score. By illuminating either "HOME" or "GUEST," for example, the pixel 71 indicates which player or team presently has possession of the ball or whom the shot clock 66 is running against.

Of course, it should be understood that more individual displays could be provided so that each expression of output information could be separately and continuously displayed. Additionally, a more streamlined preferred embodiment could utilize a single four-character display to alternately provide the score, time remaining, and shot clock information. Such an embodiment would be less expensive and smaller in overall size.

Although any of a number of alpha-numeric character displays could be used in the visual display 18, it is preferred that the electronic scoreboard 10 of the present invention utilizes a visual display 18 comprising a reflective color display which utilizes liquid crystal technology and intensifies the brightness of the visual output if ambient light increases such as in sunlight. It is also preferred that the four-character display used for displaying time and score is alpha-numeric so that if the mode of operation which regulates a game simulating the game of "HORSE" is selected, that display is capable of displaying the term "HOOP."

Figure 6:
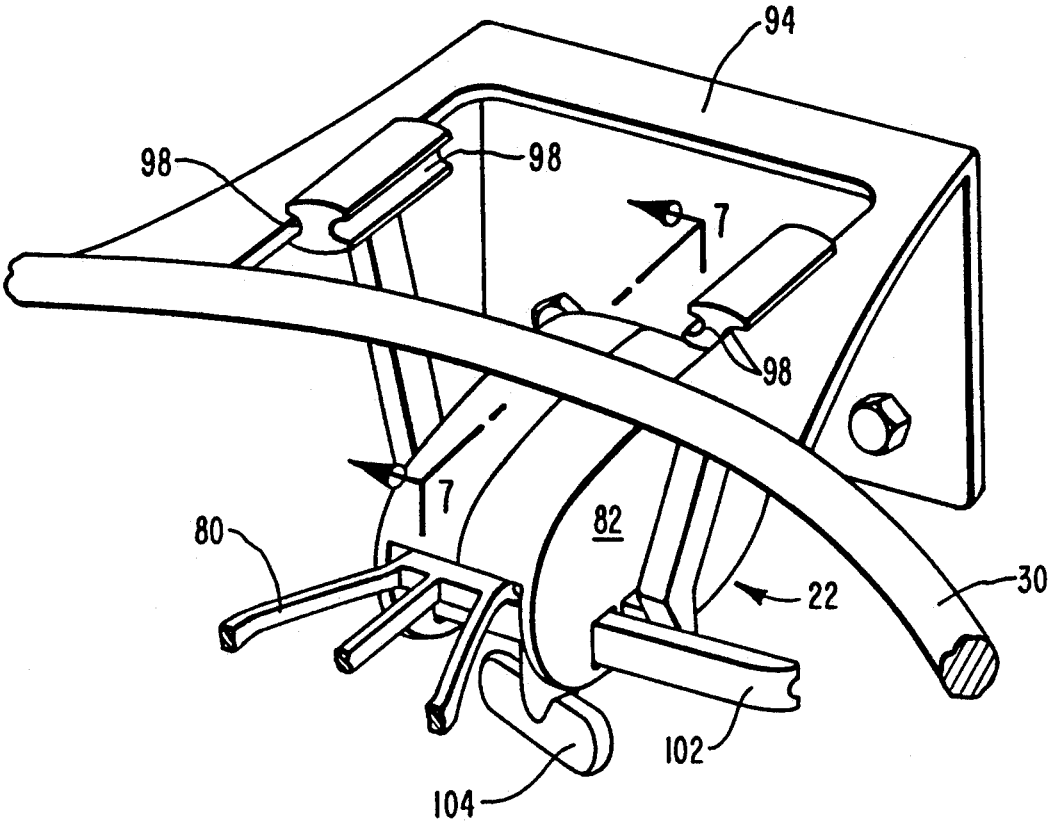
FIG. 6 is a perspective view of a portion of a basketball goal and a portion of the score registering assembly showing an alternative rim plate configuration and the manner for securing the score registering assembly thereto.
Figure 7:
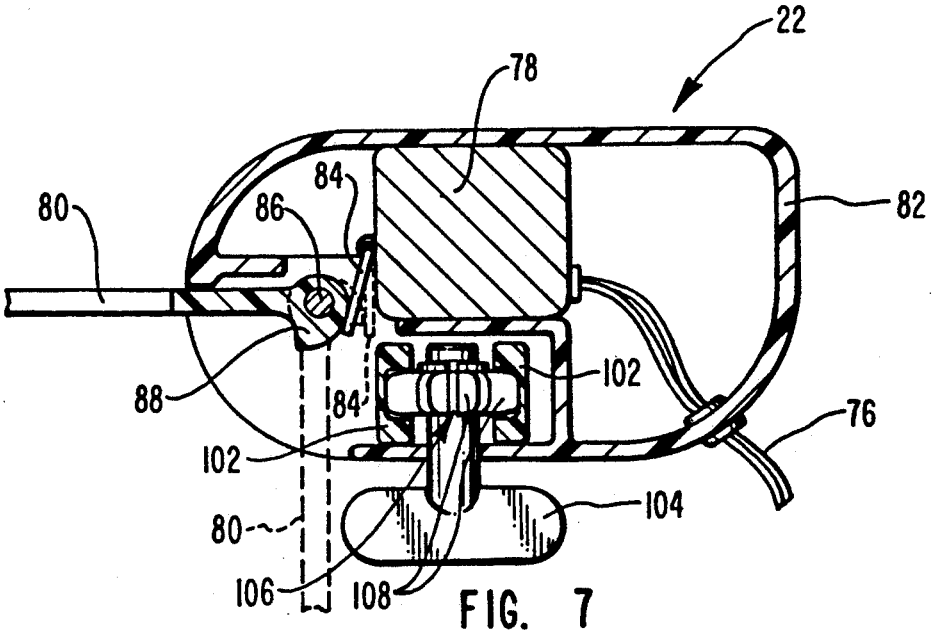
FIG. 7 is a sectional view of a portion of the score registering assembly along Line 7—7 showing the paddle cam engagement of a switch contact and the actuation of the switch is illustrated in phantom lines; and, FIG. 8 is a perspective view of the score registering assembly with portions of the paddle and the switch casing cut away to illustrate the operation of the arms as controlled by the knob.
Figure 8:
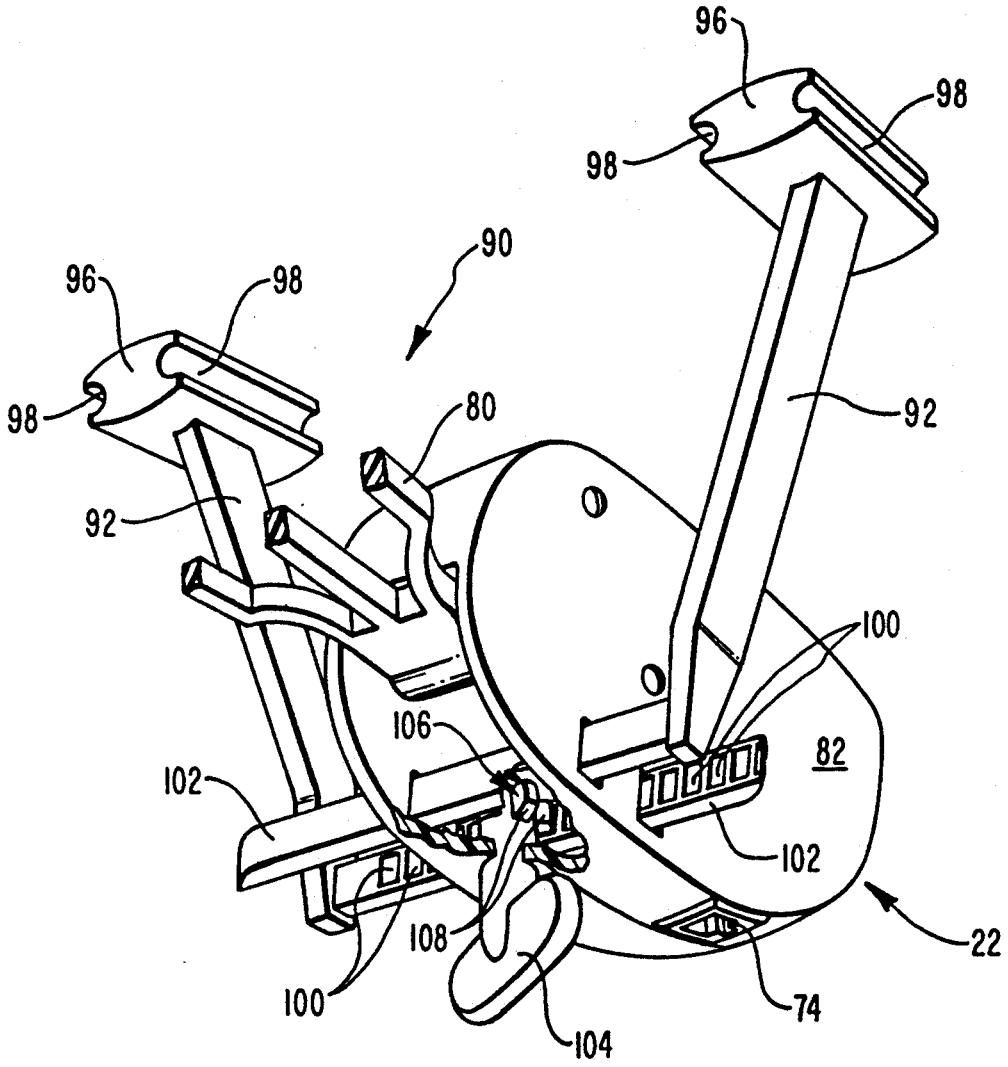

Turning now to FIGS. 6-8, the score registering assembly 22 communicates with the electronic mechanism 16 in that the power for the score registering assembly 22 is provided via the electronic mechanism 16 by the power source 46 and the score registering assembly 22 signals the electronic mechanism 16 when a basket is made. In a preferred embodiment of the present invention, a standard modular telephone cord 72 provides the communicative connection between the score registering assembly 22 and the electronic mechanism 16. With this embodiment, it is also preferred that the score registering assembly 22 and the electronic mechanism 16 each have standard modular telephone jack receivers 74. Thus, if the standard modular telephone cord 72 becomes defective, it o can be replaced easily without rendering the electronic scoreboard 10 inoperable. Although the use of a standard modular telephone cord 72 is preferred, it should be understood that other communicative connections could be used without departing from the intended scope and spirit of the invention. Another form of communicative connection is illustrated in FIG. 7 which shows hard wiring 76.

It is particularly advantageous to position the standard modular telephone jack receiver 74 for the electronic mechanism 16 in the bottom 44 of housing 12, as shown in FIGS. 1 and 5, so that the connection is shielded from the weather and less susceptible to being hit by an errant basketball.

As shown in FIGS. 1 and 6, the score registering assembly 22 may be positioned adjacent the basketball goal 30 for detecting the successful passage of a basketball through the basketball goal 30 and signaling the electronic mechanism 16 thereof. The score registering assembly 22 comprises a switch 78 (See FIG. 7) and a paddle 80. The switch 78 is disposed within a protective switch casing 82 and detects successful scores and communicates such successful scores to the electronic mechanism 16 for processing and display. The switch 78 comprises a contact 84 which is capable of movement between a neutral position (shown in FIG. 7 by solid lines) and an active position (shown is FIG. 7 by phantom lines). If the contact 84 is moved from the neutral position towards the active position, the switch 78 detects the movement and signals the electronic mechanism 16 accordingly.

The paddle 80 is biased using any of a number of conventional means for biasing and pivots about pin 86. The paddle 80 is movable between a ready position (shown in FIG. 7 by solid lines) and a reactive position (shown in FIG. 7 by phantom lines). Paddle 80 has a paddle cam 88 which engages and moves contact 84 to actuate the switch 78 if a basketball successfully passes through the basketball goal 30 causing the paddle 80 to move from the ready position to the reactive position. Preferably, the paddle 80 has a webbed design which provides structural sturdiness and durability. However, for safety reasons, if the paddle 80 has openings in its structure, it is preferred that such openings be small enough not to permit a player's fingers to get caught therein.

The score registering assembly 22 has an adjustable arm attachment assembly, generally designated 90, for securing the score registering assembly 22 to the basketball goal 30. The attachment assembly 90 has arms 92 which are laterally adjustable in a fashion similar to a rack and pinion for clamping engagement with the rim plate 94 portion of the basketball goal 30. Each arm 92 comprises a foot 96 with oppositely disposed grooves 98 and a plurality of notches 100 disposed along a lateral extension 102, the rack, of the arm 92. The movement of the arms 92 is controlled by the turning of a knob 104 with a gear 106, the pinion, which engages notches 100 in each arm 92 and advances each arm 92 if the knob 96 is turned. If the knob 104 is turned one direction, the lateral extensions 102 advance in a manner that draws the foot 96 for each arm 92 closer together, which enables the inside groove 98 for each foot 96 to clamp against the outside edges of the rim plate 94 for secure engagement. If the knob is turned the opposite direction, the lateral extensions 102 advance in a manner that pushes the foot 96 for each arm 92 farther apart, which enables the outside groove 98 for each foot 96 to clamp against the inside edges of a hollow rim plate 94 for secure engagement as shown in FIG. 6.

In a preferred embodiment of the arm attachment assembly 90, the lateral extensions 102 are somewhat flexible and each gear tooth 108 of gear 106 is oversized in length. This makes the arm attachment assembly 90 self-locking. When each gear tooth 108 is longer than the notches 100 are deep, the end of each gear tooth 108 engaging a notch 100 exerts pressure on the lateral extension 102 causing it to bow slightly at the point of engagement. This bowing of the lateral extension 102 creates a resistance that locks the arms 92 in place by biasing the lateral extension 102 against the gear tooth 108. Lateral movement of the arms 92 can be achieved by applying a sufficient turning force to the knob 104 to overcome the bowing resistance.

As can be readily seen by reference to FIGS. 1 and 6, the score registering assembly 22 can be retrofit to most existing basketball goals 30. Also, the attachment assembly 90 can be easily released by turning knob 104 the opposite direction from which it was turned to secure the attachment assembly to the rim plate 94. This enables a user to remove the score registering assembly 22 for security and storage.

Perhaps the most exciting advantage offered by the electronic scoreboard 10 of the present invention is that it converts a basketball standard in a school yard or at a home into an outdoor audio/visual experience similar to a video game. Most importantly, however, the players take an active physical role in the game.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A portable electronic scoreboard apparatus comprising:

a housing with a display face;

an electronic mechanism disposed within said housing, said electronic mechanism being capable of receiving input information, processing such input information according to a mode of operation, and displaying output information; and a score registering assembly in electronic signal communication with said electronic mechanism, said score registering assembly capable of placement in a position remote from said electronic mechanism and adjacent to a basketball goal and capable of detecting the successful passage of a basketball through the basketball goal and signaling said electronic mechanism thereof and capable of distinguishing mere contact of a basketball with the inner portion of a basketball goal from successful passage of a basketball through the basketball goal; and a random electronic coin toss selector in communication with said electronic mechanism which if actuated randomly selects between two teams and displays the team selected.

2. A portable electronic scoreboard apparatus as set forth in claim 1, further comprising:

an actuator in communication with said electronic mechanism and disposed adjacent said display face, said actuator being responsive to manually applied pressure exceeding a predetermined threshold on said housing for providing certain input information to said electronic mechanism; and a visual display disposed adjacent said display face, said visual display in communication with said electronic mechanism such that said visual display is capable of receiving said output information and displaying an expression thereof.

3. A portable electronic scoreboard apparatus as set forth in claim 2, wherein said electronic mechanism is capable of processing input information according to a plurality of modes of operation and said actuator further comprises means for selecting one of said plurality of modes of operation disposed within said housing and in communication with said electronic mechanism.

4. A portable electronic scoreboard apparatus as set forth in claim 3, further comprising a mode indicator for indicating which of said plurality of modes of operation said electronic mechanism will utilize in processing input information.

5. A portable electronic scoreboard apparatus as set forth in claim 3, wherein said electronic mechanism is capable of producing an audio signal.

6. A portable electronic scoreboard apparatus as set forth in claim 5, further comprising an audio volume selector in communication with to said electronic mechanism for regulating the volume of said audio signal.

7. A portable electronic scoreboard apparatus as set forth in claim 3, wherein said visual display comprises a shot clock in communication with and regulated by said electronic mechanism, said shot clock repeatedly counts down a predetermined period of time and visually displays such count down.

8. A portable electronic scoreboard apparatus as set forth in 7, claim further comprising a shot clock time selector in communication with said shot clock and for selecting the period of time said shot clock counts down.

9. A portable electronic scoreboard apparatus as set forth in claim 3, wherein said visual display comprises a score indicator in communication with and regulated by said electronic mechanism, said score indicator visually displays a running total score.

10. A portable electronic scoreboard apparatus as set forth in claim 9, further comprising a manual score actuator in communication with said score indicator, said manual score actuator being capable of advancing and subtracting from the score visually displayed.

11. A portable electronic scoreboard apparatus as set forth in claim 11, wherein said manual score actuator is responsive to manually applied touch of predetermined force.

12. A portable electronic scoreboard apparatus as set forth in claim 3, wherein said electronic mechanism is capable of regulating the count down of a time clock and said score indicator is capable of alternately visually displaying score and the time remaining on said time clock.

13. A portable electronic scoreboard apparatus as set forth in claim 12, further comprising a time selector in communication with said time clock for selecting the amount of time during which said time clock will continuously count down.

14. A portable electronic scoreboard apparatus as set forth in claim 13, further comprising a pause selector in communication with said electronic mechanism which if actuated is capable of interrupting the continued count down of time on said time clock.

15. A portable electronic scoreboard apparatus comprising:

a housing with a display face;

an electronic mechanism disposed within said housing, said electronic mechanism being capable of receiving input information, processing such input information according to a mode of operation, and displaying output information; and a score registering assembly in electronic signal communication with said electronic mechanism, said score registering assembly capable of placement in a position remote from said electronic mechanism and adjacent to a basketball goal and capable of detecting the successful passage of a basketball through the basketball goal and signaling said electronic mechanism thereof and capable of distinguishing mere contact of a basketball with the inner portion of a basketball goal from successful passage of a basketball through the basketball goal; said score registering assembly comprising:

a switch for detecting successful scores and communicating such successful scores to said electronic mechanism;

a paddle being movable between a ready position and a reactive position, said paddle being in actuating communication with said switch, and said paddle being capable of placement beneath a rim of the basketball goal such that a basketball successfully passing through the basketball goal moves said paddle from the ready position to the reactive position thereby actuating said switch.

16. A portable electronic scoreboard apparatus as set forth in claim 15, wherein said housing further comprises means for releasably securing said housing to a structure connected to a basketball backboard and goal, and said means for releasably securing said housing to a structure comprises a back configuration comprising a longitudinal channel disposed between a pair of flat surfaced wings.

17. A portable electronic scoreboard apparatus as set forth in claim 16, wherein said structure is a pole and said housing is capable of disposition such that said longitudinal channel engage said pole and said means for releasably securing said housing to said structure further comprises a strap fastener for disposition about said pole, said strap fastener being connected to said housing.

18. A portable electronic scoreboard apparatus as set forth in claim 17, wherein said strap fastener comprises a hook and pile fastener assembly.

19. A portable electronic scoreboard apparatus as set forth in claim 16, wherein said structure has a flat wall and said housing is capable of disposition such that said flat surfaced wings engage said flat wall and said means for releasably securing said housing to said structure further comprises a pair of slots through which fasteners are capable of disposition for secure fastening engagement of said housing to said flat wall.

20. A portable electronic scoreboard apparatus comprising:

a housing with a display face;

an electronic mechanism disposed within said housing, said electronic mechanism being capable of receiving input information, processing such input information according to a mode of operation, and displaying output information; and a score registering assembly in electronic signal communication with said electronic mechanism, said score registering assembly capable of placement in a position remote from said electronic mechanism and adjacent to a basketball goal and capable of detecting the successful passage of a basketball through the basketball goal and signaling said electronic mechanism thereof and capable of distinguishing mere contact of a basketball with the inner portion of a basketball goal from successful passage of a basketball through the basketball goal; said score registering assembly further comprising an attachment assembly comprising:

a pair of arms each having a foot for engagement with a rim plate portion of the basketball goal and a series of successive notches; and a knob having a gear for engagement with said notches such that as said knob is turned, said gear turns to engage successive notches thereby advancing said pair of arms such that if said nob is turned one direction said foot of each arm moves closer together and if said knob is turned the other direction said foot of each arm moves farther apart.

21. A portable electronic scoreboard apparatus as set forth in claim 20, wherein each said foot has a pair of oppositely disposed side grooves for engaging the edge of the rim plate of the basketball goal.

22. A portable electronic scoreboard apparatus as set forth in claim 20, wherein said gear comprises a plurality of gear teeth, each gear tooth of a length greater than the depth of said notches so that if a gear tooth engages a notch, said gear tooth causes said arm to bow at the point of engagement, thereby causing a resistance to the movement of said arm which may be overcome by a sufficient turning force applied to said knob.

23. A portable electronic scoreboard apparatus comprising:

a housing with a display face;

an electronic mechanism disposed within said housing, said electronic mechanism being capable of receiving input information, processing such input information according to a mode of operation, and displaying output information; and a score registering assembly in electronic signal communication with said electronic mechanism, said score registering assembly capable of placement in a position remote from said electronic mechanism and adjacent to a basketball goal and capable of detecting the successful passage of a basketball through the basketball goal and signaling said electronic mechanism thereof and capable of distinguishing mere contact of a basketball with the inner portion of a basketball goal from successful passage of a basketball through the basketball goal wherein said score registering assembly communicates with said electronic mechanism through a standard modular telephone cord extending between said score registering assembly and said electronic mechanism.

24. A portable electronic scoreboard apparatus as set forth in claim 23, wherein said housing has a standard modular telephone jack receiver disposed on its bottom wall for receiving said standard modular telephone cord.

25. A portable electronic scoreboard apparatus comprising:

a housing with a display face;

an electronic mechanism disposed within said housing, said electronic mechanism being capable of receiving input information, processing such input information according to a mode of operation, and displaying output information; and a score registering assembly in electronic signal communication with said electronic mechanism, said score registering assembly capable of placement in a position remote from said electronic mechanism and adjacent to a basketball goal and capable of detecting the successful passage of a basketball through the basketball goal and signaling said electronic mechanism thereof and capable of distinguishing mere contact of a basketball with the inner portion of a rim of a basketball goal from successful passage of a basketball through the basketball goal, said score registering assembly comprising:

a switch for detecting successful scores and communicating such successful scores to said electronic mechanism;

a paddle being movable between a ready position and a reactive position, said paddle being in actuating communication with said switch, and said paddle being capable of placement beneath a rom of the basketball goal such that a basketball successfully passing through the basketball goal moves said paddle from the ready position to the reactive position thereby actuating said switch; and an attachment assembly comprising:

a pair of arms each having a foot for engagement with a rim plate portion of the basketball goal and a series of successive notches; and a knob having a gear for engagement with said notches such that as said knob is turned, said gear turns to engage successive notches thereby advancing said pair of arms such that if said knob is turned one direction said foot of each arm moves closer together and if said knob is turned the other direction said foot of each arm moves farther apart.

26. A portable electronic scoreboard apparatus as set forth in claim 25, wherein said gear comprises a plurality of gear teeth, each gear tooth of a length greater than the depth of said notches so that if a gear tooth engages a notch, said gear tooth causes said arm to bow at the point of engagement, thereby causing a resistance to the movement of said arm which may be overcome by a sufficient turning force applied to said knob.

* * * * *